US011590779B2

(12) United States Patent
Hirano

(10) Patent No.: US 11,590,779 B2
(45) Date of Patent: Feb. 28, 2023

(54) IMAGE FORMING APPARATUS, POSITION DETECTION METHOD, AND COMPUTER-READABLE MEDIUM

(71) Applicant: Noboru Hirano, Kanagawa (JP)

(72) Inventor: Noboru Hirano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 22 days.

(21) Appl. No.: 17/395,364

(22) Filed: Aug. 5, 2021

(65) Prior Publication Data

US 2022/0072875 A1 Mar. 10, 2022

(30) Foreign Application Priority Data

Sep. 7, 2020 (JP) ..... JP2020-149935

(51) Int. Cl.
*B41J 29/393* (2006.01)
*B41J 11/00* (2006.01)

(52) U.S. Cl.
CPC ..... *B41J 11/0095* (2013.01); *B41J 11/008* (2013.01); *B41J 11/0045* (2013.01); *B41J 29/393* (2013.01)

(58) Field of Classification Search
CPC .... B41J 11/0095; B41J 11/008; B41J 29/393; B41J 11/46
See application file for complete search history.

(56) References Cited

U.S. PATENT DOCUMENTS

| | | | | |
|---|---|---|---|---|
| 2009/0015606 | A1 | 1/2009 | Mihara | |
| 2013/0265609 | A1 | 10/2013 | Kawabe | |
| 2015/0371116 | A1* | 12/2015 | Tanigawa | H04N 1/6044 358/1.14 |
| 2019/0163112 | A1 | 5/2019 | Nikaku et al. | |
| 2019/0238702 | A1 | 8/2019 | Ikemoto et al. | |
| 2021/0146701 | A1 | 5/2021 | Maeyama et al. | |

FOREIGN PATENT DOCUMENTS

| | | |
|---|---|---|
| JP | 2008-271473 | 11/2008 |
| JP | 4595969 | 10/2010 |
| JP | 2013-215962 | 10/2013 |
| JP | 2019-102939 | 6/2019 |
| JP | 2019-129523 | 8/2019 |

* cited by examiner

*Primary Examiner* — Julian D Huffman
(74) *Attorney, Agent, or Firm* — Duft & Bornsen, PC

(57) ABSTRACT

An image forming apparatus is configured to detect, from image data of a recording medium on which a plurality of marks are printed, positions of outer edges being edges closer to ends of the image data and positions of inner edges being inside edges not closer to the ends of the image data in both of a first direction and a second direction different from the first direction; identify, with respect to a target mark for which a reference position is to be detected and two marks adjacent to the target mark, first line segments connecting positions of inner edges and second line segments connecting positions of outer edges; and detect, as a reference position of the target mark, a midpoint of a line segment connecting an intersection of the two first line segments and an intersection of the two second line segments.

7 Claims, 9 Drawing Sheets

IMAGE FORMING APPARATUS, POSITION DETECTION METHOD, AND COMPUTER-READABLE MEDIUM

CROSS-REFERENCE TO RELATED APPLICATIONS

The present application claims priority under 35 U.S.C. § 119 to Japanese Patent Application No. 2020-149935, filed on Sep. 7, 2020. The contents of which are incorporated herein by reference in their entirety.

BACKGROUND OF THE INVENTION

1. Field of the Invention

The present invention relates to an image forming apparatus, a position detection method, and a computer-readable medium.

2. Description of the Related Art

A technology for, in an image forming apparatus, causing an in-line image reading device to detect, while a sheet of paper is being conveyed, a mark that is printed on the sheet of paper by an image forming unit, and detecting a reference position has been known.

As the image forming apparatus that detects the reference position as described above, a detection method has been disclosed in which, to detect an edge position of a rectangular mark printed on a recording medium with high accuracy, a plurality of central positions of horizontal line segments and vertical line segments in a reading portion are detected, regression calculation is performed to obtain line segments from arrangement of the detected lines, and an intersection of a horizontal line segment and a vertical line segment is detected as the edge position of the mark (for example, Japanese Unexamined Patent Application Publication No. 2013-215962).

However, in the conventional technology, there is a problem in that when the mark printed on the recording medium is distorted in a specific manner due to bleeding, deformation, or the like, a detected reference position of the mark is largely deviated from an original reference position.

SUMMARY OF THE INVENTION

According to an aspect of the present invention, an image forming apparatus includes a first detecting unit, an identifying unit, and a second detecting unit. The first detecting unit is configured to detect, from image data of a recording medium on which a plurality of marks are printed, positions of outer edges being edges closer to ends of the image data and positions of inner edges being inside edges not closer to the ends of the image data in both of a first direction and a second direction different from the first direction. The identifying unit is configured to identify, with respect to a target mark for which a reference position is to be detected and two marks adjacent to the target mark, first line segments connecting positions of inner edges and second line segments connecting positions of outer edges. The second detecting unit is configured to detect, as a reference position of the target mark, a midpoint of a line segment connecting an intersection of the two first line segments connecting the positions of the inner edges and an intersection of the two second line segments connecting the positions of the outer edges.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
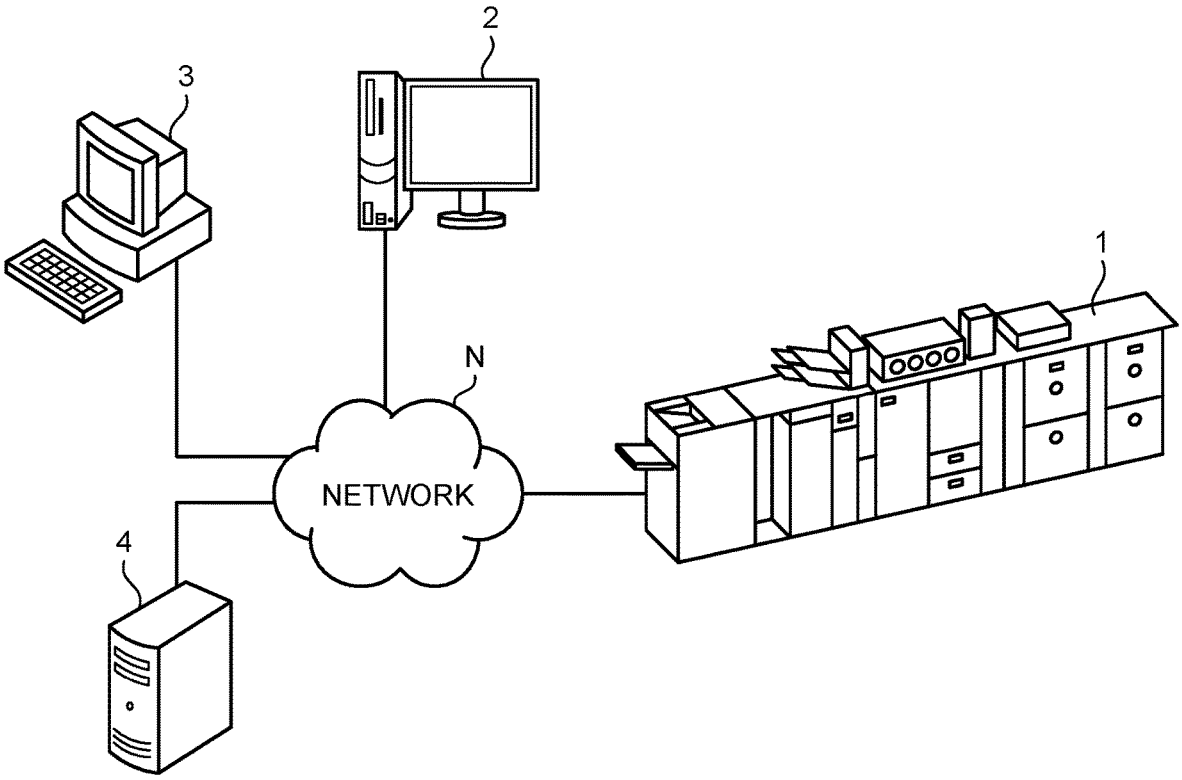
FIG. 1 is a diagram illustrating an example of an entire configuration of a print system according to one embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to provide an image forming apparatus, a position detection method, and a computer-readable medium capable of preventing deviation of a detected reference position of a mark from an original reference position when the mark is distorted in a specific manner.

Embodiments of an image forming apparatus, a position detection method, and a computer readable recording medium according to the present invention will be described in detail below with reference to the drawings. The present invention is not limited by the embodiments below, and structural elements in the embodiments below include one that can easily be thought of by a person skilled in the art, one that is practically identical, and one that is within an equivalent range. In addition, the structural elements may be omitted, replaced, modified, or combined in various modes within the scope not departing from the gist of the embodiments described below.

Entire Configuration of Print System

FIG. 1 is a diagram illustrating an example of an entire configuration of a print system according to one embodiment. The entire configuration of the print system according to the embodiment will be described below with reference to FIG. 1.

As illustrated in FIG. 1, as one example, the print system according to the present embodiment includes an image forming apparatus 1, a digital front end (DFE) 2, a client personal computer (PC) 3, and a management server 4. As illustrated in FIG. 1, all of the devices are able to perform data communication with one another via a network N. The network N is, for example, a network including a local area network (LAN), the Internet, or the like, and is a wired network, a wireless network, or a network including both of a wired network and a wireless network.

The image forming apparatus 1 is an inkjet printer (liquid discharge apparatus) that performs image formation (printing) on a recording medium by an ink-jet method on the basis of drawing data (image data) received from the DFE 2. Meanwhile, a specific hardware configuration and a schematic functional configuration of the image forming apparatus 1 will be described later with reference to FIG. 2 and FIG. 5.

The DFE 2 is an information processing apparatus that receives a print job from the client PC 3 or the management server 4, generates drawing data by a raster image processor (RIP) engine on the basis of the print job, and transmits the drawing data to the image forming apparatus 1. Meanwhile, a specific hardware configuration of the DFE 2 will be described later with reference to FIG. 3.

The client PC 3 is an information processing apparatus that generates a print job to be printed by a user and transmits the print job to the DFE 2 or the management server 4. Meanwhile, a specific hardware configuration of the client PC 3 will be described later with reference to FIG. 4.

The management server 4 is a server apparatus that manages the print job received from the client PC 3 and transmits the print job to the DFE 2 in response to a request from the DFE 2. Meanwhile, a specific hardware configuration of the management server 4 will be described later with reference to FIG. 4.

Hardware Configuration of Image Forming Apparatus

Figure 2:
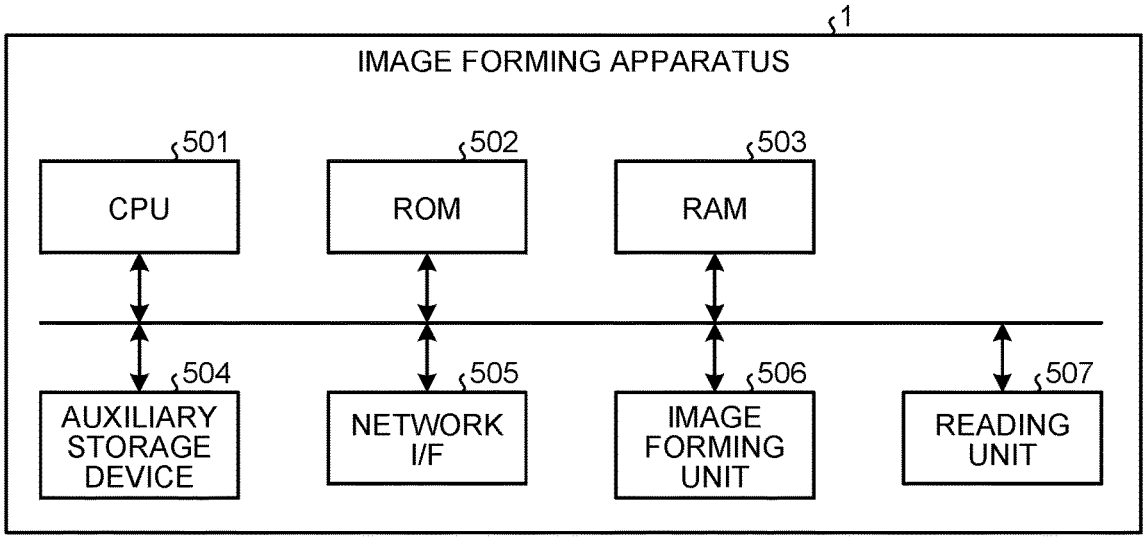
FIG. 2 is a diagram illustrating an example of a hardware configuration of an image forming apparatus according to the embodiment.

FIG. 2 is a diagram illustrating an example of a hardware configuration of the image forming apparatus according to the embodiment. The hardware configuration of the image forming apparatus 1 according to the present embodiment will be described with reference to FIG. 2.

As illustrated in FIG. 2, the image forming apparatus 1 includes a central processing unit (CPU) 501, a read only memory (ROM) 502, a random access memory (RAN) 503, an auxiliary storage device 504, a network interface (I/F) 505, an image forming unit 506, and the reading unit 507.

The CPU 501 is an arithmetic device that controls the entire image forming apparatus 10. The ROM 502 is a nonvolatile storage device that stores therein a program, data, and the like. The RAM 503 is a volatile storage device which is used as a work area for the CPU 501 and on which a program, data, and the like are loaded.

The auxiliary storage device 504 is a storage device, such as a hard disk drive (HDD), a solid state drive (SSD), or a flash memory, and serves as a storage for accumulating image data, for accumulating programs, for accumulating font data, for accumulating forms, and the like.

The network I/F 505 is an interface for performing communication with an external apparatus that is connected via the network N established by a wired or wireless data transmission path, for example. The network I/F 505 is, for example, an interface that is compatible with transmission control protocol (TCP)/Internet protocol (IP).

The image forming unit 506 is a printing device that performs image formation (printing) by an ink-jet method of discharging ink onto a recording medium.

The reading unit 507 is a scanner that performs read operation on the recording medium on which an image is formed by the image forming unit 506.

The CPU 501, the ROM 502, the RAM 503, the auxiliary storage device 504, the network I/F 505, the image forming unit 506, and the reading unit 507 as described above are communicably connected to one another via a bus, such as an address bus and a data bus.

Meanwhile, the hardware configuration of the image forming apparatus 1 illustrated in FIG. 2 is one example, and it is not necessary to include all of the structural elements illustrated in FIG. 2 and it is possible to include other structural elements.

Hardware Configuration of DFE

Figure 3:
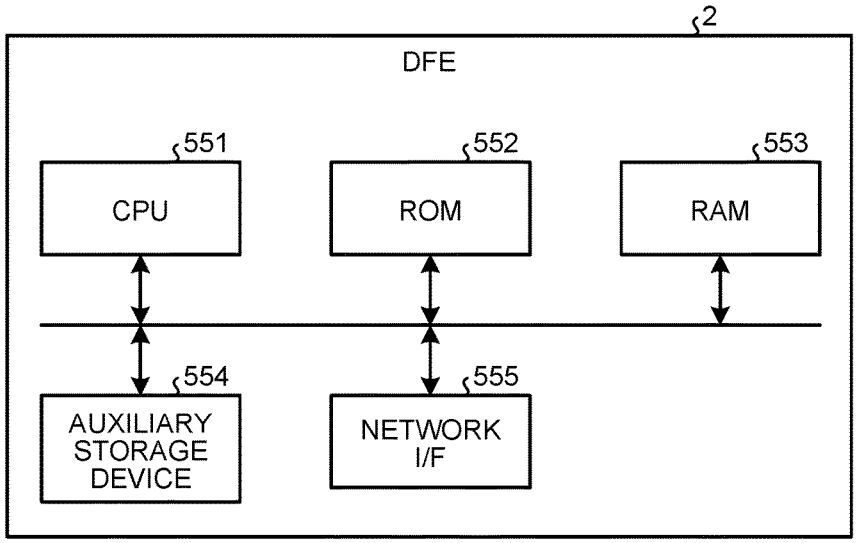
FIG. 3 is a diagram illustrating an example of a hardware configuration of a digital front end (DFE) according to the embodiment.

FIG. 3 is a diagram illustrating an example of the hardware configuration of the DFE according to the embodiment. The hardware configuration of the DFE 2 according to the present embodiment will be described below with reference to FIG. 3.

As illustrated in FIG. 3, the DFE 2 includes a CPU 551, a ROM 552, a RAM 533, an auxiliary storage device 554, and a network I/F 555.

The CPU 551 is an arithmetic device that controls entire operation of the DFE 2. The ROM 552 is a nonvolatile storage device that stores therein a program for the DFE 2. The RAM 533 is a volatile storage device that is used as a work area for the CPU 551.

The auxiliary storage device 554 is a storage device, such as an HDD or an SSD, for storing various kinds of data, programs, and the like.

The network I/F 555 is an interface for performing data communication with the image forming apparatus 1, the client PC 3, and the management server 4 via the network N. The network I/F 555 is, for example, a network interface card (NIC) or the like that is compatible with Ethernet (registered trademark) and allows communication compatible with TCP/IP or the like.

The CPU 551, the ROM 552, the RAM 533, the auxiliary storage device 554, and the network I/F 555 as described above are communicably connected to one another via a bus, such as an address bus and a data bus.

Meanwhile, the hardware configuration of the DFE 2 illustrated in FIG. 3 is one example, and it is not necessary to include all of the structural elements illustrated in FIG. 3 and it is possible to include other structural elements.

Hardware Configurations of Client PC and Management Server

Figure 4:
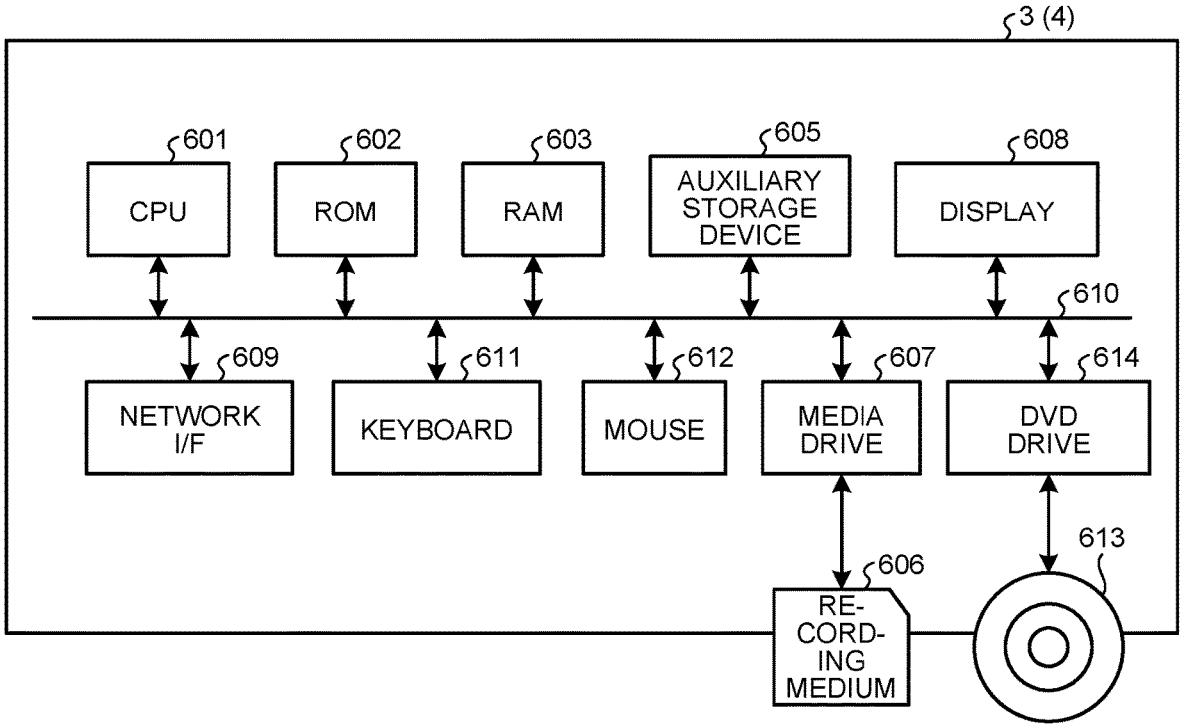
FIG. 4 is a diagram illustrating an example of a hardware configuration of a client PC according to the embodiment.

FIG. 4 is a diagram illustrating an example of the hardware configuration of the client PC according to the embodiment. The hardware configurations of the client PC 3 and the management server 4 according to the present embodiment will be described below with reference to FIG. 4. Meanwhile, in the following description, the configuration of the client PC 3 will be described.

As illustrated in FIG. 4, the client PC 3 includes a CPU 601, a ROM 602, a RAM 603, an auxiliary storage device 605, a media drive 607, a display 608, a network I/F 609, a keyboard 611, a mouse 612, and a digital versatile disk (DVD) drive 614.

The CPU 601 is an arithmetic device that controls entire operation of the client PC 3. The ROM 602 is a nonvolatile storage device that stores therein a program for the client PC 3. The RAM 603 is a volatile storage device that is used as a work area for the CPU 601.

The auxiliary storage device 605 is a storage device, such as an HDD or an SSD, for storing various kinds of data, programs, and the like. The media drive 607 is a device that controls read and write of data with respect to a recording medium 606, such as a flash memory, under the control of the CPU 601.

The display 608 is a display device configured with liquid crystal, organic electro-luminescence (EL), or the like for displaying various kinds of information, such as a cursor, a menu, a window, a character, or an image.

The network I/F 609 is an interface for performing data communication with an external apparatus, such as the DFE 2 and the management server 4, by using the network N. The network I/F 609 is, for example, an NIC or the like that is compatible with Ethernet and allows communication compatible with TCP/IP or the like.

The keyboard 611 is an input device for selecting a character, a numeral, or various instructions and moving a cursor, for example. The mouse 612 is an input device for selecting end executing various instructions, selecting a processing target, and moving a cursor, for example.

The DVD drive 614 is a device that controls read and write of data with respect to a DVD 613, such as a DVD-ROM or a DVD-recordable (DVD-R), which is one example of a removable storage medium.

The CPU 601, the ROM 602, the RAM 603, the auxiliary storage device 605, the media drive 607, the display 608, the network I/F 609, the keyboard 611, the mouse 612, and the DVD drive 614 as described above are communicably connected to one another via a bus line 610, such as an address bus and a data bus.

Meanwhile, the hardware configuration of the client PC illustrated in FIG. 4 is one example, and it is not necessary to include all of the structural elements illustrated in FIG. 4 and it is possible to include other structural elements.

Further, the hardware configuration of the management server 4 is the same as the hardware configuration illustrated in FIG. 4.

Schematic Configuration of Image Forming Apparatus

Figure 5:
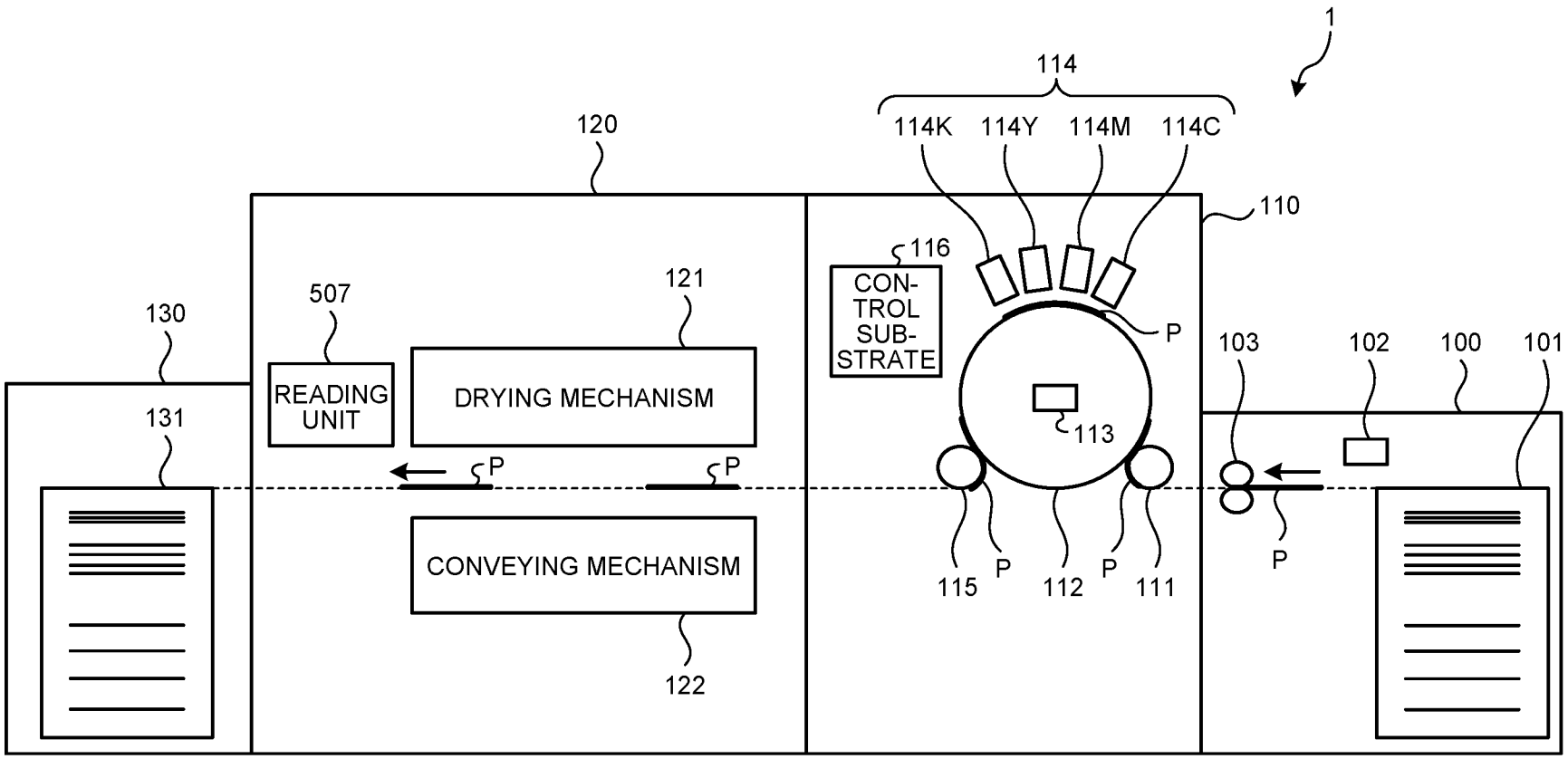
FIG. 5 is a diagram illustrating an example of a schematic configuration of the image forming apparatus according to the embodiment.

FIG. 5 is a diagram illustrating an example of a schematic configuration of the image forming apparatus according to the embodiment. The functional schematic configuration of the image forming apparatus 1 according to the present embodiment will be described below with reference to FIG. 5.

The image forming apparatus 1 is an inkjet printer that performs image formation (printing) on a recording medium by the ink-jet method as described above. As illustrated in FIG. 5, the image forming apparatus 1 includes a paper feed unit 100, an image forming unit 110, a drying unit 120, and a paper discharge unit 130. The image forming apparatus 1 causes the image forming unit 110 to form an image with ink, which is liquid for image formation, on a recording medium P that is a sheet material fed from the paper feed unit 100, causes the drying unit 120 to dry the ink attached to the recording medium P, and causes the paper discharge unit 130 to discharge the recording medium P.

The paper feed unit 100 is a unit that feeds the recording medium P as a sheet material to the image forming unit 110. The paper feed unit 100 includes a paper feed tray 101, a feed device 102, and a registration roller pair 103.

The paper feed tray 101 is a tray on which a plurality of sheets of recording medium P are stackable.

The feed device 102 is a device that separates the sheets of recording medium P one by one from the paper feed tray 101 and feeds the recording medium P to a conveying path. As the feed device 102, various feed devices, such as a device using a roller or a ball or a device using air suction, may be used.

The registration roller pair 103 is a roller pair that sends the recording medium P fed from the feed device 102 to the image forming unit 110 at a predetermined timing.

Meanwhile, the configuration of the paper feed unit 100 is not limited to the configuration as illustrated in FIG. 5 as long as the paper feed unit 100 includes a mechanism that is able to feed the recording medium P to the image forming unit 110.

The image forming unit 110 is a unit that forms an image with ink, which is liquid for image formation, on the recording medium P that is fed from the paper feed unit 100. Meanwhile, the image forming unit 110 may be regarded as being corresponding to the image forming unit 506 as described above or may be regarded as a liquid discharge apparatus. The image forming unit 110 includes a receiving drum 111, a paper bearing drum 112, a suction device 113, an inkjet head 114, a transfer drum 115, and a control substrate 116.

The receiving drum 111 is a roller member that receives the recording medium P fed from the paper feed unit 100. The receiving drum 111 holds the received recording medium P by a paper gripper that is arranged on a surface thereof, and conveys the recording medium P to the paper bearing drum 112 along the surface.

The paper bearing drum 112 is a drum member that bears, by an outer surface thereof, the recording medium P conveyed by the receiving drum 111, and conveys the recording medium P along the outer surface. Further, a paper gripper is also arranged on a surface of the paper bearing drum 112, and a leading end of the recording medium P is held by the paper gripper. A plurality of suction holes are formed in a distributed manner on the outer surface of the paper bearing drum 112.

The suction device 113 is a device that generates, at each of the suction holes formed on the outer surface of the paper bearing drum 112, suction airflow toward an inside of the paper bearing drum 112, and causes the recording medium P to stick to the outer surface of the paper bearing drum 112.

The inkjet head 114 is a liquid discharge head that discharges ink toward the recording medium P bore on the paper bearing drum 112, to thereby form an image. The inkjet head 114 includes an inkjet head 114C for discharging ink of cyan (C), an inkjet head 114M for discharging ink of magenta (M), an inkjet head 114Y for discharging ink of yellow (Y), and an inkjet head 114K for discharging ink of black (K), and forms an image by discharging ink of the four colors. In other words, the inkjet heads 114C, 114M, 114C, and 114K discharge ink of the respective colors when the recording medium P bore on the paper bearing drum 112 passes through opposing regions, so that an image corresponding to image data is formed. Meanwhile, a phrase "inkjet head 114" will be used to indicate any of the inkjet heads 114C, 114M, 114C, and 114K or collectively indicate the inkjet heads 114C, 114M, 114C, and 114K. Further, configurations of the inkjet heads 114C, 114M, 114Y, and 114K are not specifically limited as long as it is possible to discharge ink, and, it is possible to adopt every kind of configurations. Furthermore, it may be possible to arrange a liquid discharge head that discharges special ink, such as white ink, gold ink, or silver ink, or a liquid discharge head that discharges liquid, such as surface coating liquid, that is not used for an image, as needed basis. Moreover, an electrical configuration of the inkjet head 114 will be described later with reference to FIG. 6.

The transfer drum 115 is a roller member that transfers the recording medium P conveyed by the paper bearing drum 112 to the drying unit 120.

The control substrate 116 is a control substrate that controls ink discharge operation of the inkjet head 114. The control substrate 116 controls discharge operation of the inkjet head 114 by a driving signal (drive waveform) corresponding to the image data.

The drying unit 120 is a unit that dries the ink attached to the recording medium P on which the image is formed by the image forming unit 110. The drying unit 120 includes a drying mechanism 121, a conveying mechanism 122, and a reading unit 507.

The drying mechanism 121 is a mechanism that performs a drying process on the ink on the recording medium P that is conveyed by the conveying mechanism 122, to thereby evaporate moisture or the like from the ink, fix the ink to the recording medium P, and prevent the recording medium P from bending.

The conveying mechanism 122 is a mechanism that receives the recording medium P conveyed from the image forming unit 110, and conveys the recording medium P inside the drying unit 120.

The reading unit 507 is, as described above, a scanner that performs read operation on the recording medium P on which the image is formed by the image forming unit 110. The reading unit 507 performs the read operation on the recording medium P that is subjected to the drying process by the drying mechanism 121.

The paper discharge unit 130 is a unit for stacking the recording medium P conveyed from the drying unit 120. The paper discharge unit 130 includes a paper discharge tray 131.

The paper discharge tray 131 is a tray for sequentially stacking and holding the recoding medium P conveyed from the drying unit 120.

Meanwhile, the configuration of the paper discharge unit 130 is not limited to the configuration as illustrated in FIG. 5 as long as it is possible to discharge the recording medium P.

While the image forming apparatus 1 illustrated in FIG. 5 includes the paper feed unit 100, the image forming unit 110, the drying unit 120, and the paper discharge unit 130, it may be possible to appropriately add other units. For example, it is possible to add a pre-processing unit, which performs pre-processing for image formation, between the paper feed unit 100 and the image forming unit 110, or may add a post-processing unit, which performs post-processing for image formation, between the drying unit 120 and the paper discharge unit 130. The pre-processing unit may be, for example, a unit that performs a treatment liquid application process of applying treatment liquid to the recording medium P in order to prevent bleeding due to reaction with the ink or the like, but details of the pre-processing are not specifically limited. Further, the post-processing unit may be, for example, a paper inverting conveyance unit that inverting the recording medium P on which an image is formed by the image forming unit 110 and feeds the recording medium P to the image forming unit 110 again to form images on both sides of the recording medium P, a processing unit that binding a plurality of sheets of recording medium P on which images are formed, correction mechanism processing unit that corrects deformation of a sheet, a cooling mechanism that cools the recording medium P, or the like, but details of the post-processing are not specifically limited. Furthermore, in the example of the image forming apparatus 1 illustrated in FIG. 5, a configuration for a single-sided conveyance is illustrated, but the configuration is not limited to this example, and a configuration for a double-sided conveyance may be adopted. With this configuration, it is possible to cause the reading unit 507 to detect a detection mark printed on a front surface, and correct an image on a back surface depending on a detection result.

Configuration and Operation of Functional Blocks of Image Forming Apparatus

Figure 6:
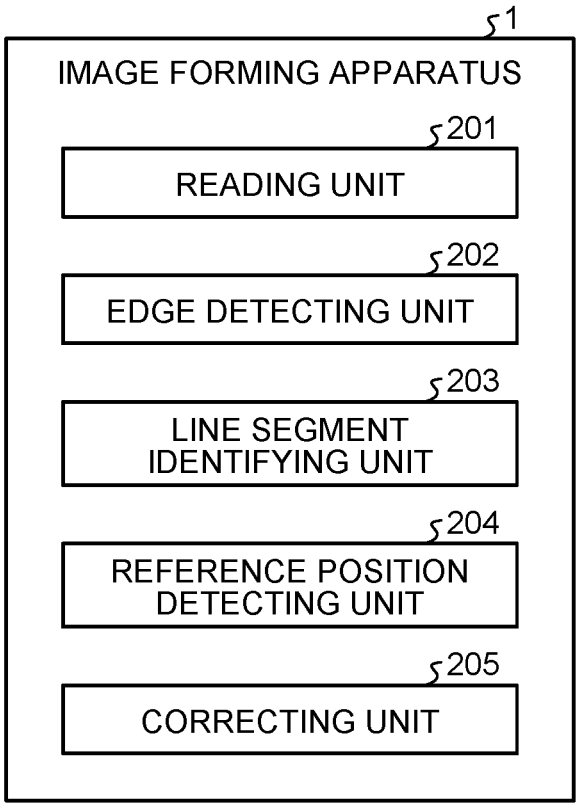
FIG. 6 is a diagram illustrating an example of a configuration of functional blocks of the image forming apparatus according to the embodiment.
Figure 7:
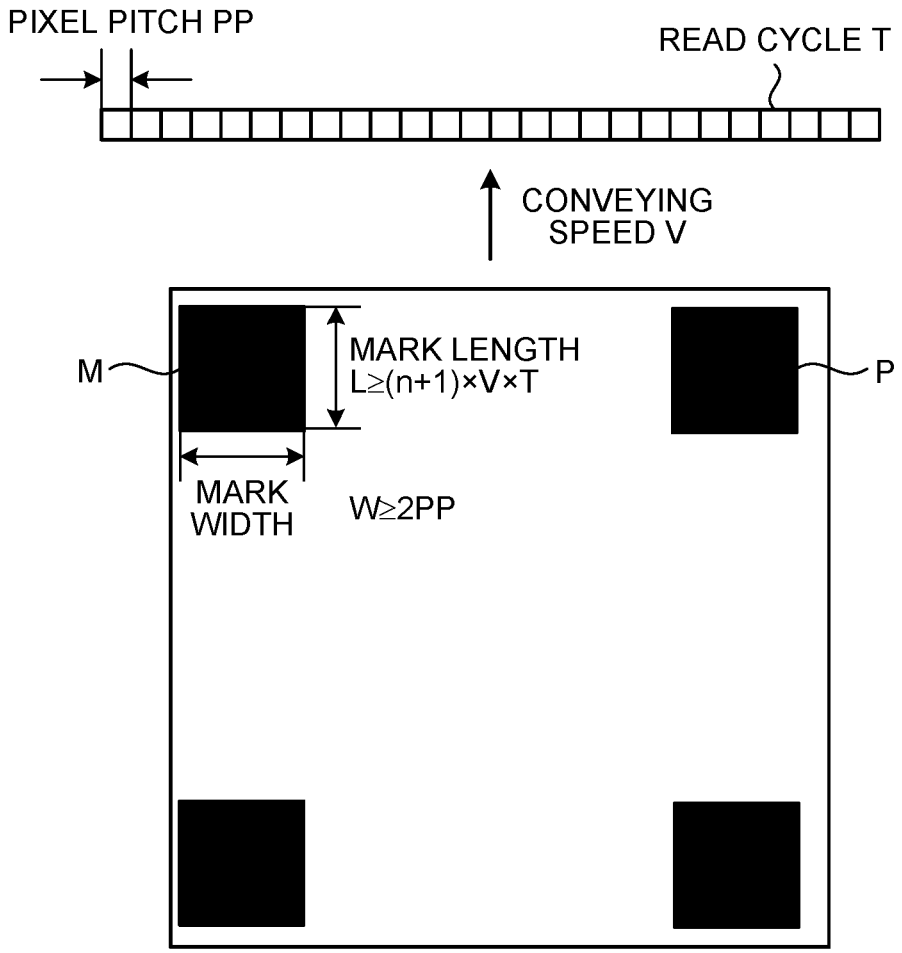
FIG. 7 is a diagram for explaining a configuration of detection marks.
Figure 8:
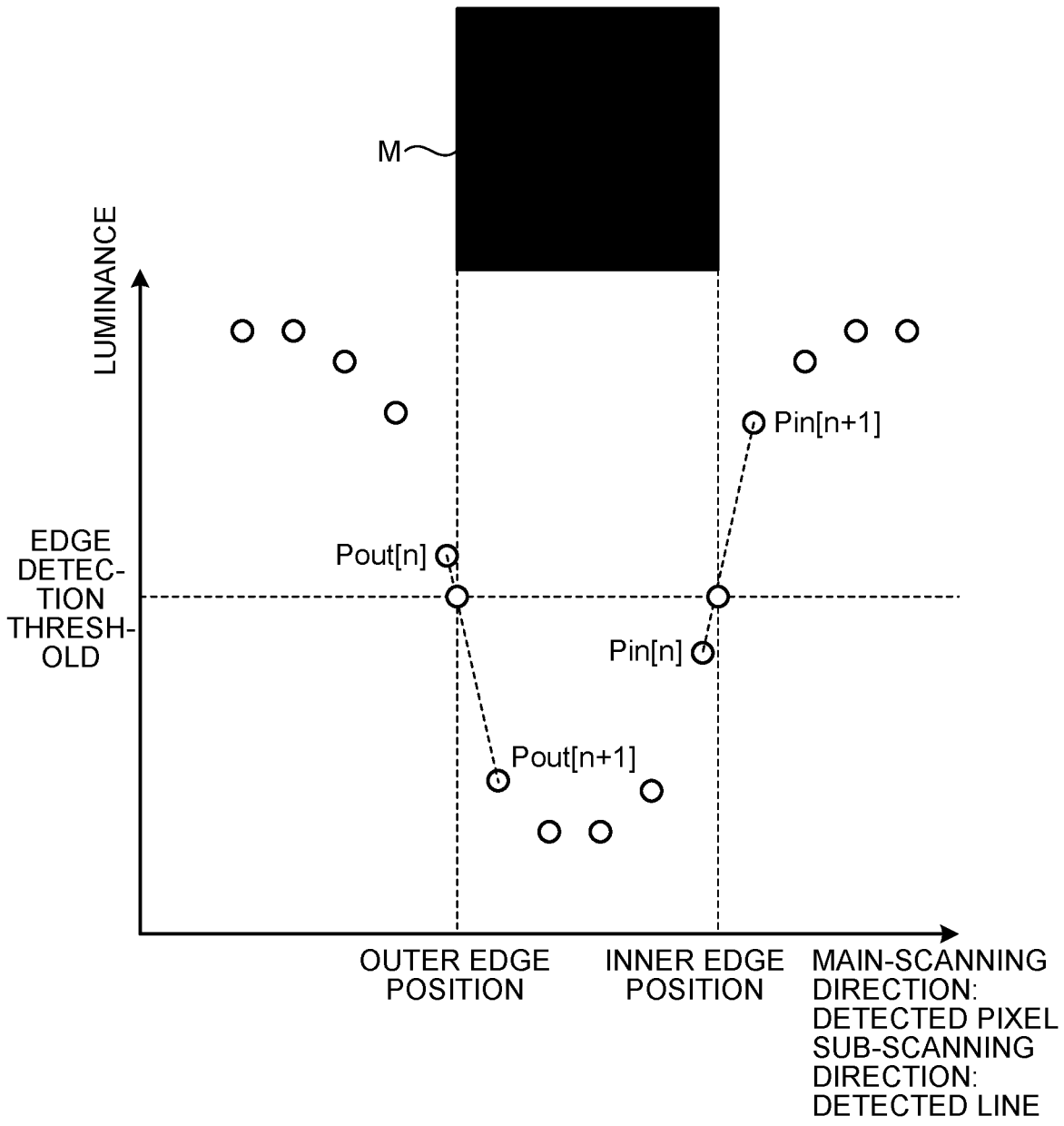
FIG. 8 is a diagram for explaining a method of detecting edge positions of the detection marks.
Figure 9:
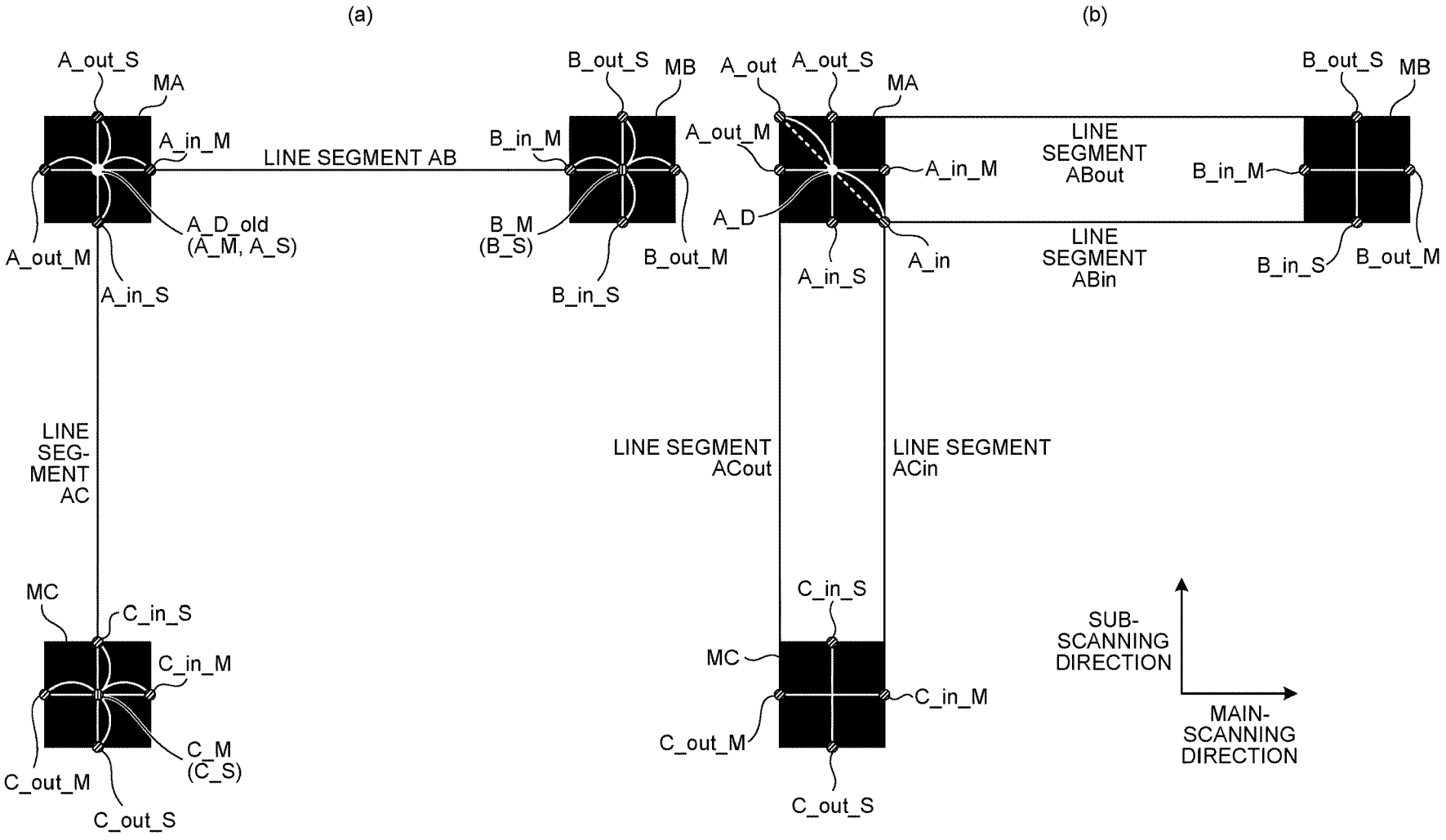
FIG. 9 is a diagram for comparison between a conventional method of detecting a reference position and a method of detecting a reference position by the image forming apparatus according to the embodiment.

FIG. 6 is a diagram illustrating an example of a configuration of functional blocks of the image forming apparatus according to the embodiment. FIG. 7 is a diagram for explaining a configuration of detection marks. FIG. 8 is a diagram for explaining a method of detecting edge positions of the detection marks. FIG. 9 is a diagram for comparison between a conventional method of detecting a reference position and a method of detecting a reference position by the image forming apparatus according to the embodiment. The configuration and operation of the functional blocks of the image forming apparatus 1 according to the present embodiment will be described below with reference to FIG. 6 to FIG. 9.

As illustrated in FIG. 6, the image forming apparatus 1 includes a reading unit 201, an edge detecting unit 202 (first detecting unit), a line segment identifying unit 203 (identifying unit), a reference position detecting unit 204 (second detecting unit), and a correcting unit 205.

The reading unit 201 is a functional unit that acquires image data that is read through the read operation performed by the reading unit 507 with respect to the recording medium P on which the detection marks as illustrated in FIG. 7 are printed (images are formed) by the image forming unit 110.

As illustrated in FIG. 7, it is assumed that detection marks M for detecting reference positions are printed at four corners of the recording medium P. Further, assuming that a pixel pitch of the reading unit 507 is denoted by PP, a read cycle is denoted by T, and a conveying speed of the conveying mechanism 122 in a conveying direction is denoted by V, the reading unit 507 performs the read operation on the recording medium P on which the detection marks M are printed, and the reading unit 201 acquires the read image data. Here, to detect the detection marks M from the image data, a mark length L that is a length of each of the detection marks M in the conveying direction (in the sub-scanning direction) needs to meet Expression (1) below.

$$L \geq (n+1) \times V \times T (n \geq 1) \quad (1)$$

Further, to detect the detection marks M from the image data, a mark width W that is a length of each of the detection marks M in a direction (in the main-scanning direction) perpendicular to the conveying direction needs to meet Expression (2) below.

$$W \geq 2PP \quad (2)$$

Meanwhile, it is sufficient to determine the mark length L and the mark width W in advance in accordance with printing accuracy and conveying accuracy.

The reading unit 201 is implemented by, for example, causing the CPU 501 illustrated in FIG. 2 to execute a program. Meanwhile, the reading unit 201 may be implemented by the reading unit 507 illustrated in FIG. 2.

The edge detecting unit 202 is a functional unit that detects positions of an inside edge (inner edge) and an outside edge (outer edge) in each of the main-scanning direction (one example of a first direction) and the sub-scanning direction (one example of a second direction) from the image data acquired from the reading unit 201. Here, the outside edge, that is, the outer edge, indicates an edge of the detection mark M in the image data closer to an end of the image data (end the recording medium P), and is present in each of the main-scanning direction and the sub-scanning direction. Further, the inside edge, that is, the inner edge, indicates an edge of the detection mark M in the image data inside of, not closer to end of the image data, and is present in each of the main-scanning direction and the sub-scanning direction.

A method of detecting the positions of the edges of the detection marks M in the image data by the edge detecting unit 202 will be described below with reference to FIG. 8. In FIG. 8, explanation will be given based on the assumption that a horizontal axis represents a position based on a detected pixel in the case of the main-scanning direction and represents a position based on a detected line in the case of the sub-scanning direction, a left side in paper view of FIG. 8 represents the outside of the recording medium P, and a right side represents the inside of the recording medium P. A predetermined edge detection threshold is set for read luminance that is a pixel value (read value) of the image data, and the edge detecting unit 202 calculates detection positions before and after the edge detection threshold. Here, in the case of outer edge detection, a detection position just before the edge detection threshold is denoted by Pout[n] and a detection position just after the edge detection threshold is denoted by Pout[n+1], and, in the case of inner edge detection, a detection position just before the edge detection threshold in detecting the inner edge is denoted by Pin[n] and a detection position just after the edge detection threshold is denoted by Pin[n+1]. In this case, the edge detecting unit 202 is able to detect the position of the edge by linear interpolation with respect to the two points Pout[n] and Pout[n+1] in the case of outer edge detection, and is able to detect the position of the edge by linear interpolation with respect to the two points Pin[n] and Pin[n+1] in the case of inner edge detection, with higher accuracy than detection resolution of the reading unit 507. In other words, the edge detecting unit 202 detects the positions of the outer edge and the inner edge on the basis of two read luminances before and after crossing the edge detection threshold in each of the main-scanning direction and the sub-scanning direction of the detection mark M.

Meanwhile, the edge detecting unit 202 may detect the positions of the edges by performing curve interpolation with respect to anteroposterior multiple points (three or more points), instead of the two points.

Further, as for a position to be detected in a specific side of the detection mark M, for example, it is sufficient to adopt a position corresponding to a center (a central position of the mark length L in the sub-scanning direction and a central position of the mark width W in the main-scanning direction) based on the assumption that the detection mark M is printed at an ideal position at which the detection mark M is expected to be printed on the recording medium P. With this configuration, even if printing misalignment or conveyance deviation (skew, shift, or the like) of the recording medium P occurs, it is possible to improve edge detection accuracy. Alternatively, it may be possible to search for the detection mark M in a certain range instead of determining an edge detection position in advance, and detect a position of an edge on the basis of the position of the retrieved detection mark M.

The edge detecting unit 202 is implemented by, for example, causing the CPU 501 illustrated in FIG. 2 to execute a program.

The line segment identifying unit 203 is a functional unit that identifies a line segment (one example of a first line segment) that connects the positions of the inner edges and identifies a line segment (one example of a second line segment) that connects the positions of the outer edges, where the inner edges and the outer edges are detected by the edge detecting unit 202 with respect to a target detection mark (target mark) for which a reference position is to be detected and detection marks that are adjacent to the target detection mark. Here, if it is assumed that a detection mark MA illustrated at (b) in FIG. 9 is adopted as the target detection mark for which the reference position is to be detected, a detection mark MB and a detection mark MC are the detection marks adjacent to the detection mark MA. The line segment identifying unit 203 is implemented by, for example, causing the CPU 501 illustrated in FIG. 2 to execute a program.

The reference position detecting unit 204 is a functional unit that detects, as the reference position of the detection mark, a center of gravity between an intersection of the two line segments connecting the positions of the inner edges and an intersection of the two line segments connecting the positions of the outer edges (a midpoint of a line segment that connects the two intersections), where the line segments are identified by the line segment identifying unit 203. The reference position detecting unit 204 is implemented by, for example, causing the CPU 501 illustrated in FIG. 2 to execute a program.

Here, a conventional method of detecting the reference position and a method of detecting the reference position by the image forming apparatus 1 according to the embodiment will be described below with reference to FIG. 9. FIG. 9 illustrates, at (a), the conventional method of detecting the reference position, and illustrates, at (b), the method of detecting the reference position by the image forming apparatus 1 according to the embodiment. Meanwhile, in FIG. 9, for the sake of convenience, the detection mark MA at the upper left is adopted as the target detection mark for which the reference position is to be detected, and a detection mark MB at the upper right and a detection mark MC at the lower left are adopted as two detection marks adjacent to the detection mark MA.

At (a) and (b) in FIG. 9, a position of an outer edge of the detection mark MA in the main-scanning direction is referred to as a point A_out_M, a position of an inner edge of the detection mark MA in the main-scanning direction is referred to as the point A_in_M, a position of an outer edge of the detection mark MA in the sub-scanning direction is referred to as a point A_out_S, and a position of an inner edge of the detection mark MA in the sub-scanning direction is referred to as a point A_in_S, where the positions are detected by the edge detecting unit 202. Further, a position of an outer edge of the detection mark MB in the main-scanning direction is referred to as a point B_out_M, a position of an inner edge of the detection mark MB in the main-scanning direction is referred to as a point B_in_M, a position of an outer edge of the detection mark MB in the sub-scanning direction is referred to as a point B_out_S, and a position of an inner edge of the detection mark MB in the sub-scanning direction is referred to as a point B_in_S, where the positions are detected by the edge detecting unit 202. Furthermore, a position of an outer edge of the detection mark MC in the main-scanning direction is referred to as a point C_out_M, a position of an inner edge of the detection mark MC in the main-scanning direction is referred to as point C_in_M, a position of an outer edge of the detection mark MC in the sub-scanning direction is referred to as a point C_out_S, and a position of an inner edge of the detection mark MC in the sub-scanning direction is referred to as a point C_in_S, where the positions are detected by the edge detecting unit 202.

First, the method of detecting the reference position of the detection mark according to the conventional technology will be described below with reference to (a) in FIG. 9.

In the conventional technology, positions of midpoints in the main-scanning direction and in the sub-scanning direction are calculated from four edge positions of each of the detection marks. Accordingly, a total of six points are calculated as the midpoints in the main-scanning direction and in the sub-scanning direction with respect to the detection marks MA, MB, and MC. Specifically, in the detection mark MA, a midpoint of a line segment connecting the point A_out_M and the point A_in_M as the edge positions in the main-scanning direction is calculated as a point A_M, and a midpoint of a line segment connecting the point A_out_S and the point A_in_S as the edge positions in the sub-scanning direction is calculated as a point A_S. Furthermore, in the detection mark MB, a midpoint of a line segment connecting the point B_out_M and the point B_in_M as the edge positions in the main-scanning direction is calculated as a point B_M, and a midpoint of a line segment connecting the point B_out_S and the point B_in_S as the edge positions in the sub-scanning direction is calculated as a point B_S. Moreover, in the detection mark MC, a midpoint of a line segment connecting the point C_out_M and the point C_in_M as the edge positions in the main-scanning direction is calculated as a point C_M, and a midpoint of a line segment connecting the point C_out_S and the point C_in_S in the sub-scanning direction as the edge positions in the sub-scanning direction is calculated as a point C_S.

Furthermore, in the conventional technology, a line segment is drawn by connecting the midpoints of the adjacent detection marks in the main-scanning direction, and another line segment is drawn by connecting the midpoints of the adjacent detection marks in the sub-scanning direction. Specifically, a line segment AB is drawn by connecting the point A_S, which is the midpoint of the detection mark MA in the sub-scanning direction, and the point B_S, which is the midpoint of the detection mark MB adjacent to the detection mark MA in the sub-scanning direction. Further, a line segment AC is drawn by connecting the point A_M, which is the midpoint of the detection mark MA in the main-scanning direction, and the point C_M, which is the midpoint of the detection mark MC adjacent to the detection mark MA in the main-scanning direction. Furthermore, an intersection (the point A_D_old) between the line segment AB and the line segment AC is detected as the reference position of the detection mark MA.

Next, the method of detecting the reference position of the detection mark by the image forming apparatus 1 will be described below with reference to (b) in FIG. 9. In the image forming apparatus 1 according to the present embodiment, the midpoints in the main-scanning direction and in the sub-scanning direction are not calculated from the four edge positions of each of the detection marks.

First, the line segment identifying unit 203 identifies a line segment connecting the positions of the inner edges and a line segment connecting the positions of the outer edges detected by the edge detecting unit 202, with respect to the target detection mark a for which the reference position is to be detected and the detection mark adjacent to the target detection mark. Specifically, with respect to the detection marks MA and MB that are adjacent to each other in the main-scanning direction, the line segment identifying unit 203 identifies a line segment ABout by connecting the point A_out_S and the point B_out_S that are the detection positions of the outer edges in the sub-scanning direction, and identifies a line segment ABin by connecting the point A_in_S and the point B_in_S that are the detection positions of the inner edges in the sub-scanning direction. Further, with respect to the detection marks MA and MC that are adjacent to each other in the sub-scanning direction, the line segment identifying unit 203 identifies a line segment ACout by connecting the point A_out_M and the point C_out_M that are the detection positions of the outer edges in the main-scanning direction, and identifies a line segment ACin by connecting the point A_in_M and the point C_in_M that are the detection positions of the inner edges in the main-scanning direction.

Then, the reference position detecting unit 204 detects, as the reference position of the detection mark, the center of gravity between an intersection of the two line segments connecting the positions of the inner edges and an intersection of the two line segments connecting the positions of the outer edges (the midpoint of the line segment connecting the two intersections), where the line segments are identified by the line segment identifying unit 203. Specifically, the reference position detecting unit 204 detects, as the reference position of the detection mark MA, a point A_D that is a center of gravity between the intersection Aout of the line segment ABout and the line segment ACout, which connect the detection positions of the outer edges and which are identified by the line segment identifying unit 203, and the intersection Ain of the line segment ABin and the line segment ACin, which connect the detection positions of the inner edges and which are identified by the line segment identifying unit 203 (the midpoint of the line segment connecting the intersection Ain and the intersection Aout). The reference position detecting unit 204 detects the reference position of each of the detection marks in the same manner as described above.

As illustrated at (a) and (b) in FIG. 9, it is understood that the same reference position is detected if the detection mark is not distorted due to bleeding, deformation, or the like. A difference in the reference position that is detected when the detection mark is distorted due to bleeding, deformation or the like will be described later with reference to FIGS. 10A to 10C and FIG. 11.

The correcting unit 205 is a functional unit that corrects the image data on the basis of the reference position of the detection mark detected by the reference position detecting unit 204. The correcting unit 205 is implemented by, for example, causing the CPU 501 illustrated in FIG. 2 to execute a program.

Meanwhile, at least one of the reading unit 201, the edge detecting unit 202, the line segment identifying unit 203, the reference position detecting unit 204, and the correcting unit 205 may be implemented by an integrated circuit, such as an application specific integrated circuit (ASIC) or a field-programmable gate array (FPGA).

Further, each of the functional units of the image forming apparatus 1 illustrated in FIG. 6 is functionally conceptual, and need not always be configured as illustrated in the drawings. For example, a plurality of functional units illustrated as independent functional units in the image forming apparatus 1 illustrated in FIG. 6 may be configured as a single functional unit. Alternatively, the function of a single functional unit included in the image forming apparatus illustrated in FIG. 6 may be divided into a plurality of functions, and a plurality of functional units may be configured.

Operation of Detecting Reference Position when Detection Mark is Distorted

Figure 10A:
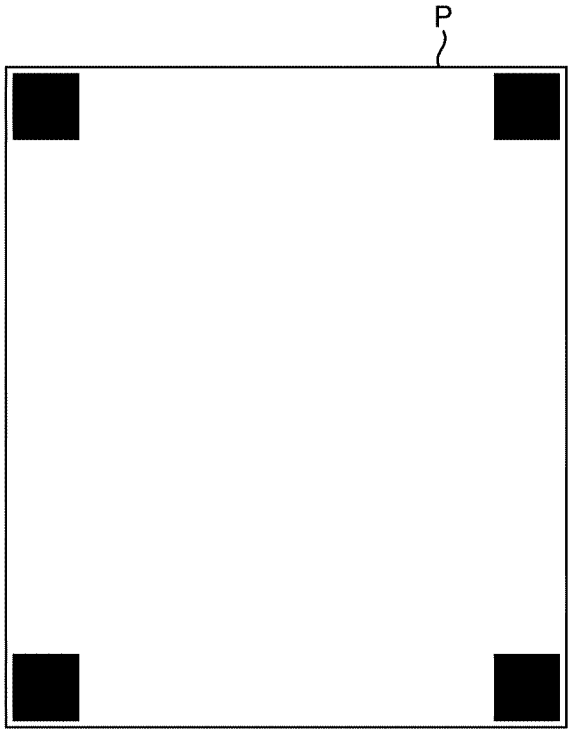
FIGS. 10A to 10C are diagrams for explaining bleeding of the detection mark.
Figure 10B:
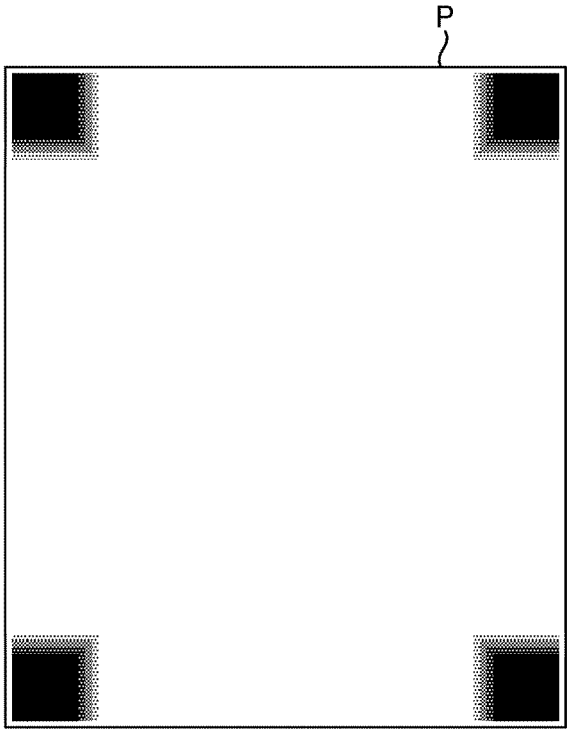
Figure 10C:
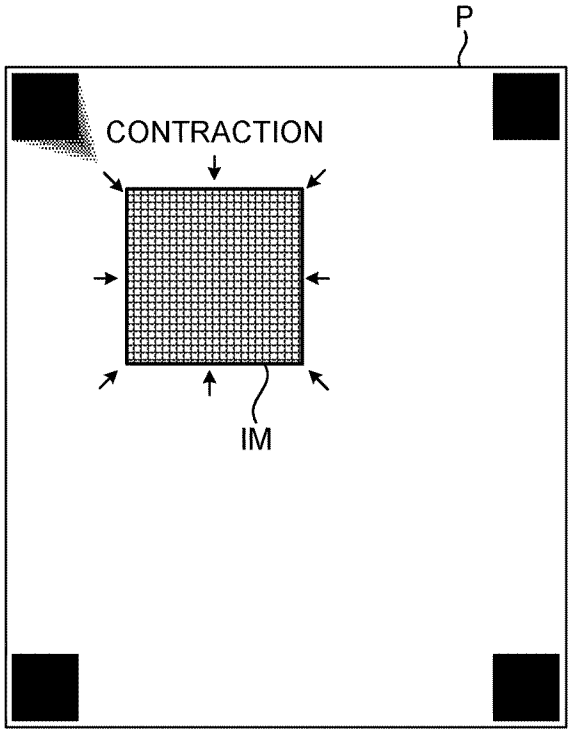
Figure 11:
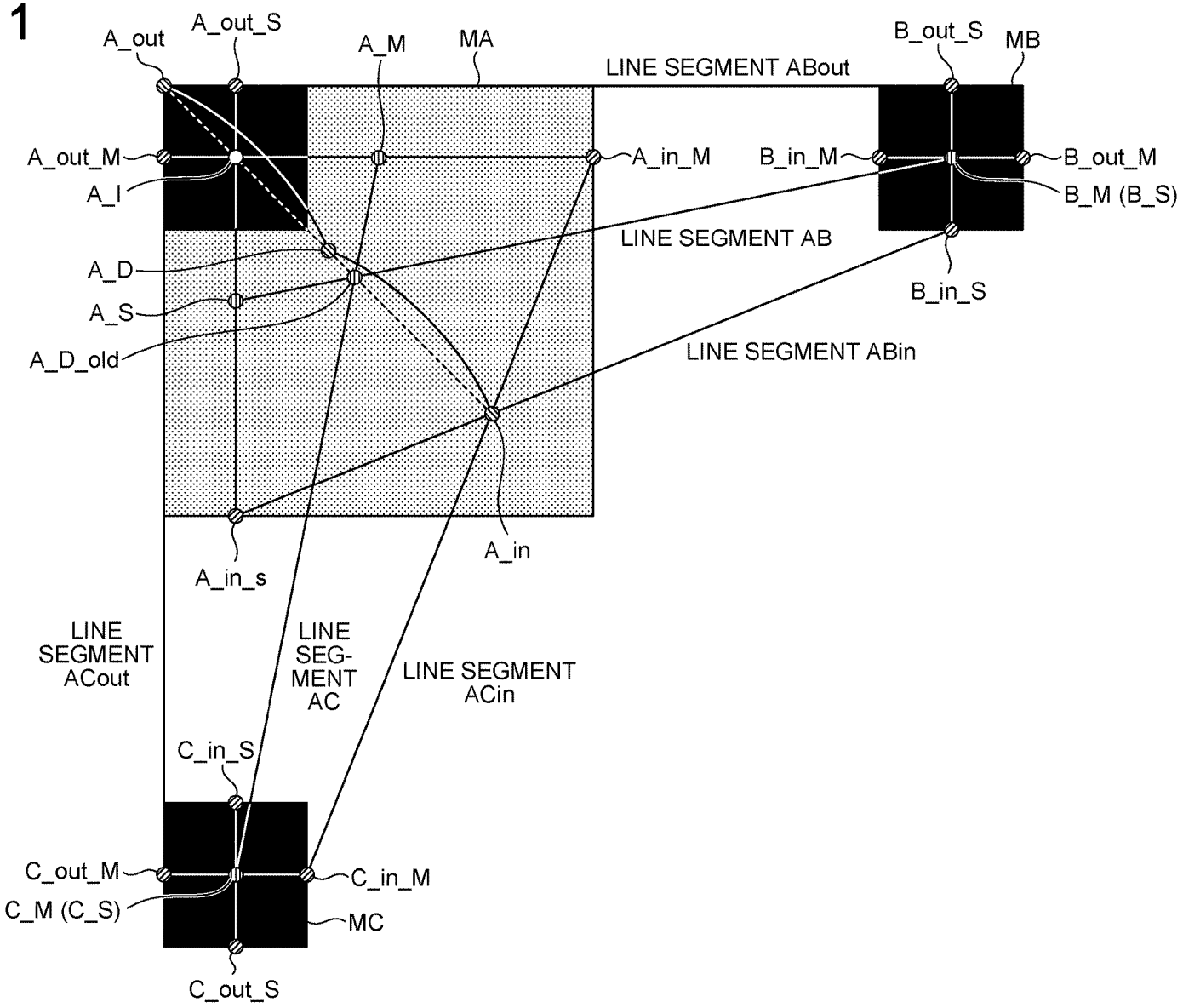
FIG. 11 is a diagram for comparison between conventional operation of detecting the reference position and operation of detecting the reference position by the image forming apparatus according to the embodiment in a case where bleeding of the detection mark occurs.

FIGS. 10A to 10C is a diagram for explaining bleeding of the detection mark. FIG. 11 is a diagram for comparison between conventional operation of detecting the reference position and operation of detecting the reference position by the image forming apparatus according to the embodiment in a case where bleeding of the detection mark occurs. With reference to FIGS. 10A to 10C and FIG. 11, the operation of detecting the reference position by the image forming apparatus 1 according to the present embodiment in a case where bleeding of the detection mark occurs will be described below.

A state of a detection mark printed on the recording medium P will be described below with reference to FIGS. 10A to 10C. FIG. 10A is a diagram illustrating an ideal print state of detection marks that are not distorted due to bleeding, deformation, or the like, and FIG. 10B is a diagram illustrating a print state in which a specific detection mark (a detection mark at an upper left) largely bleeds inwardly. For example, when aqueous ink is printed on the recording medium P, ink bleeding may occur due to permeability of the ink with respect to the recording medium P. Further, if a drying condition on the printed recording medium P is not uniform in the entire surface of recording medium P, amounts of bleeding may vary among the detection marks printed at four corners. Furthermore, it is preferable to print the detection marks at positions as close as possible to the four corners of the recording medium P if four end portions of the recording medium P are to be detected, and under the condition in which large bleeding occurs, as illustrated in FIG. 10B, bleeding toward outside the detection marks is limited by the edges of the recording medium P, so that bleeding toward inside may increase.

FIG. 10C illustrates an example of a state in which sizes of the detection marks vary due to distortion of the detection mark caused by contraction of the recording medium on which an image IM is printed. For example, as illustrated in FIG. 10C, if the image IM with high ink density is present only in the vicinity of the detection mark at the upper left, a portion including the image IM contracts after being dried, and the portion including the image IM is pulled due to the contraction. Because of the action as described above, only the detection mark at the upper left is deformed inwardly, and the same condition as in the case in which large bleeding occurs toward inside as illustrated in FIG. 10B may occur when detecting the reference position of the detection mark.

Next, with reference to FIG. 11, the conventional operation of detecting the reference position and the operation of detecting the reference position by the image forming apparatus 1 according to the present embodiment in a case in which only the detection mark MA at the upper left among the detection marks printed at the four corners of the recording medium P is largely distorted inwardly due to bleeding, deformation or the like will be described below. In the detection mark MA illustrated in FIG. 11, a dark shaded portion indicates an ideal detection mark, and a light shaded portion indicates a portion in which distortion has occurred due to bleeding, deformation, or the like.

In FIG. 11, by the conventional method of detecting the reference position and the method of detecting the reference position by the image forming apparatus 1 according to the present embodiment as described above with reference to FIG. 9, the reference position of the detection mark MA is detected by detecting the positions of the inner edges and the outer edges of each of the detection marks, identifying each of the line segments, and obtaining the intersections of the line segments. Meanwhile, with use of the conventional method of detecting the reference position, the point A_M, the point A_S, and the point A_D_old overlap with one another in FIG. 9, but the three points are detected as different points in FIG. 11 due to the distortion of the detection mark MA.

A point A_I indicates an ideal reference position of the detection mark MA. However, in the conventional method of detecting the reference position, the point A_D_old that is the intersection of the line segment AB and the line segment AC (the reference position of the detection mark MA according to the conventional method) is largely deviated from the point A_I due to the distortion of the detection mark MA. In contrast, with use of the method of detecting the reference position performed by the image forming apparatus 1 according to the present embodiment, although the point A_D between the intersection Ain of the line segment ABin and the line segment ACin connecting the detection positions of the inner edges and the intersection Aout of the line segment ABout and the line segment ACout connecting the detection positions of the outer edges (the midpoint of the line segment connecting the intersection Ain and the intersection Aout) is deviated from the point A_I, the amount of deviation is smaller than that of the conventional point A_D_old. In other words, if the detection mark MA is distorted inwardly as described above, a distance from the reference position (the point A_D) detected by the method according to the present embodiment to the ideal reference position (the point A_I) is smaller than a distance from the reference position (the point A_D_old) detected by the conventional method to the ideal reference position (the point A_I). This is because, with respect to an ideal line segment, that is, a line segment connecting the position (the point A_I) at which the point A_D_old is expected to be detected and the reference position of the detection mark MC (substantially the line segment AC illustrated at (a) in FIG. 9), an inclination difference (error) of a line segment connecting the reference position (the point A_D) detected by the method according to the embodiment and the reference position of the detection mark MC is smaller than an inclination difference (error) of a line segment connecting the reference position (the point A_D_old) detected by the conventional method and the reference position of the detection mark MC.

As described above, in the image forming apparatus 1 according to the present embodiment, the edge detecting unit 202 detects the positions of the inner edges and the outer edges in the main-scanning direction and the sub-scanning direction for each of the detection marks from image data acquired by the reading unit 201, the line segment identifying unit 203 identifies, with respect to a target detection mark for which a reference position is to be detected and two detection marks adjacent to the target detection mark, line segments connecting the positions of the inner edges and line segments connecting the positions of the outer edges, and the reference position detecting unit 204 detects, as the reference position of the detection mark, a center of gravity between an intersection of the two line segments connecting the positions of the inner edges and an intersection of the two line segments connecting the positions of the outer edges (a midpoint of a line segment connecting the two intersections). With this configuration, when the detection mark is distorted in a specific manner (for example, distorted inwardly), it is possible to prevent deviation of a detected reference position of the mark from an original reference position.

Meanwhile, in each of the embodiments as described above, if at least any of the functional units of the image forming apparatus 1 is implemented by execution of a program, the program is distributed by being incorporated in a ROM or the like in advance. Further, in each of the embodiments as described above, the program executed by the image forming apparatus 1 may be provided by being recorded in a computer readable recording medium, such as a CD-ROM, a flexible disk (FD), a CD-recordable (CD-R), or a DVD, in a computer-installable or computer-executable file format. Furthermore, in each of the embodiments as described above, the program executed by the image forming apparatus 1 may be stored in a computer connected to a network, such as the Internet, and may be provided by download via the network. Moreover, in each of the embodiments as described above, the program executed by the image forming apparatus 1 may be provided or distributed via the network, such as the Internet. Furthermore, in each of the embodiments as described above, the program executed by the image forming apparatus 1 has a module structure including at least any of the functional units as described above, and as actual hardware, the CPU 501 reads a program from the storage device as described above (the ROM 502 or the auxiliary storage device 504) and executes the program, so that each of the functional units is loaded and generated onto the main storage device (the RAM 503).

According to an embodiment, it is possible to prevent deviation of a detected reference position of a mark from an original position when the mark is distorted in a specific manner.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus comprising:

a printing device configured to print a plurality of marks on a recording medium;

a scanner configured to read the recording medium on which the marks are printed by the printing device; and a CPU and memory configured to implement:

a first detecting unit configured to detect, from image data read by the scanner, positions of outer edges being edges closer to ends of the image data and positions of inner edges being inside edges not closer to the ends of the image data in both of a first direction and a second direction different from the first direction;

an identifying unit configured to identify, with respect to a target mark for which a reference position is to be detected and two marks adjacent to the target mark, first line segments connecting the positions of the inner edges and second line segments connecting the positions of the outer edges; and a second detecting unit configured to detect, as the reference position of the target mark, a midpoint of a line segment connecting an intersection of the two first line segments connecting the positions of the inner edges and an intersection of the two second line segments connecting the positions of the outer edges.

2. The image forming apparatus according to claim 1, wherein:

the CPU and memory are further configured to implement:

a correcting unit configured to correct image data, based on the reference position of each mark detected by the second detecting unit.

3. The image forming apparatus according to claim 1, wherein the first detecting unit is configured to detect the positions of the outer edges and the positions of the inner edges, based on luminances before and after crossing a predetermined threshold in each of the first direction and the second direction for each mark.

4. The image forming apparatus according to claim 3, wherein the first detecting unit detects the positions of the outer edges and the positions of the inner edges by performing linear interpolation with respect to two luminances before and after crossing the predetermined threshold in each of the first direction and the second direction for each mark.

5. The image forming apparatus according to claim 3, wherein the first detecting unit is configured to detect the positions of the outer edges and the positions of the inner edges by curve interpolation with respect to three or more luminances before and after crossing the predetermined threshold in each of the first direction and the second direction for each mark.

6. A position detection method comprising:

printing a plurality of marks on a recording medium with a printing device;

reading the recording medium on which the marks are printed by the printing device with a scanner;

first detecting, from image data read by the scanner, positions of outer edges being edges closer to ends of the image data and positions of inner edges being inside edges not closer to the ends of the image data in both of a first direction and a second direction different from the first direction;

identifying, with respect to a target mark for which a reference position is to be detected and two marks adjacent to the target mark, first line segments connecting the positions of the inner edges and second line segments connecting the positions of the outer edges; and second detecting, as the reference position of the target mark, a midpoint of a line segment connecting an intersection of the two first line segments connecting the positions of the inner edges and an intersection of the two second line segments connecting the positions of the outer edges.

7. A non-transitory computer-readable medium including programmed instructions that cause a computer to execute:

printing a plurality of marks on a recording medium with a printing device;

reading the recording medium on which the marks are printed by the printing device with a scanner;

first detecting, from image data read by the scanner, positions of outer edges being edges closer to ends of the image data and positions of inner edges being inside edges not closer to the ends of the image data in both of a first direction and a second direction different from the first direction;

identifying, with respect to a target mark for which a reference position is to be detected and two marks adjacent to the target mark, first line segments connecting the positions of the inner edges and second line segments connecting the positions of the outer edges; and second detecting, as the reference position of the target mark, a midpoint of a line segment connecting an intersection of the two first line segments connecting the positions of the inner edges and an intersection of the two second line segments connecting the positions of the outer edges.

* * * * *